United States Patent [19]

Oliff

[11] 4,216,861

[45] Aug. 12, 1980

[54] TUBULAR CARTON

[75] Inventor: James R. Oliff, Austell, Ga.

[73] Assignee: The Mead Corporation, Dayton, Ohio

[21] Appl. No.: 965,928

[22] Filed: Dec. 4, 1978

[51] Int. Cl.[3] ..... B65D 65/12; B65D 65/28

[52] U.S. Cl. ..... 206/427; 206/611; 229/40; 229/49; 229/DIG. 11

[58] Field of Search ..... 229/40, DIG. 11, 49, 229/37 E, 38, 39 R; 206/427, 611

[56] References Cited

U.S. PATENT DOCUMENTS

| | | | |
|---|---|---|---|
| 2,936,069 | 5/1960 | Dunning | 206/427 |
| 3,110,434 | 11/1963 | Linda et al. | 206/611 X |
| 3,203,584 | 8/1965 | Forrer | 229/40 X |
| 3,512,697 | 5/1970 | Robinson | 229/39 R |
| 3,807,624 | 4/1974 | Funkhouser | 229/40 |
| 3,904,036 | 9/1975 | Forrer | 206/427 |
| 3,923,234 | 12/1975 | Lund, Jr. | 229/40 |
| 3,994,432 | 11/1976 | Kirby, Jr. | 206/427 X |

FOREIGN PATENT DOCUMENTS

| | | | |
|---|---|---|---|
| 35518 | 12/1921 | Norway | 206/611 |

*Primary Examiner*—Stephen P. Garbe

*Attorney, Agent, or Firm*—Walter M. Rodgers; Walter A. Rodgers

[57] ABSTRACT

A tubular carton comprising bottom (1), top (6,7), and a pair of side walls (2,3) interconnected to form a sleeve together with end closure structure comprising an end flap (16,17,20,21,24,25,28,29,32,33) foldably joined to each end of the top, bottom, and side walls and being disposed perpendicular to the axis of the sleeve, and web structure (42–49) interconnecting two adjacent end flaps at each corner of the carrier.

4 Claims, 7 Drawing Figures

TUBULAR CARTON

TECHNICAL FIELD

This invention concerns a tubular carton with increased strength and rigidity which is accomplished through the utilization of improved carton corner structure.

BACKGROUND ART

It is known to form carton corners by means of various forms of web structure. Characteristically these cartons become deformed when the fully loaded carton is transported. Of course this results in an unsatisfactory appearance as well as impaired structural integrity.

A tubular carton comprising a bottom wall, a pair of side walls foldably joined respectively to the side edges of the bottom wall, a top wall foldably joined along the side edges thereof respectively to the upper edges of the side walls, an end flap foldably joined to each end of the top, bottom, and side walls, at least a portion of each end flap being disposed perpendicular to the axis of the sleeve, web structure interconnecting two adjacent end flaps at each corner of the carton, and a bend line disposed in one of the adjacent end flaps.

BEST MODE FOR CARRYING OUT THE INVENTION

Figure 1:
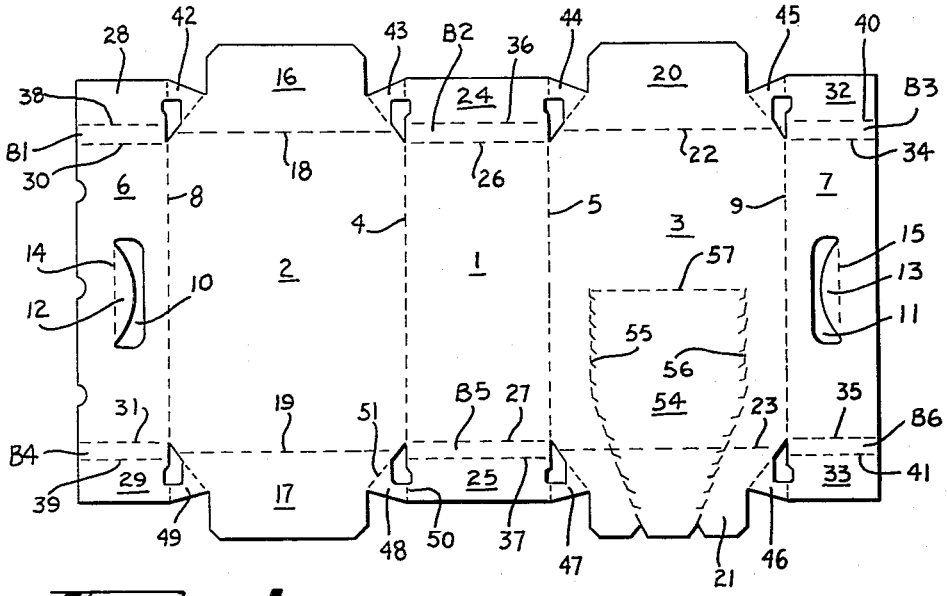
FIG. 1 is a plan view of a blank from which the tubular carton is formed according to this invention.

With reference to the drawings, the numeral 1 designates the bottom wall of the carton to the side edges of which side walls 2 and 3 are foldably joined along fold lines 4 and 5 respectively. The top wall of the carton is formed by a combination of top panels 6 and 7 which are foldably joined respectively to the upper edges of side walls 2 and 3 along fold lines 8 and 9. Carrying means is provided for the carton and is formed by hand carrying apertures 10 and 11 which are struck from top panels 6 and 7 respectively. In addition cushioning flaps 12 and 13 are provided and are foldably joined respectively to top panels 6 and 7 along fold lines 14 and 15.

End closure structure, in part, is provided for the carton in the form of end flaps 16 and 17 which are foldably joined to the end edges of side wall 2 along fold lines 18 and 19 respectively. In addition end flaps 20 and 21 are foldably joined to the end edges of side wall 3 along fold lines 22 and 23 respectively. In like fashion, end flaps 24 and 25 are foldably joined to the end edges of bottom wall 1 along fold lines 26 and 27 respectively.

Additional end closure structure is provided in the form of partial end flaps 28 and 29 which are foldably joined to the end edges of top panel 6 along fold lines 30 and 31 respectively. Likewise partial end flaps 32 and 33 are foldably joined to the end edges of top panel 7 along fold lines 34 and 35 respectively. According to a feature of this invention, bend lines 36, 37, 38, 39, 40 and 41 are formed in end flaps 24 and 25 and partial end flaps 28, 29, 32, and 33 respectively and define bevelled corner panels B1-B6.

As is apparent from FIG. 1, bend lines 36–41 are offset outwardly of fold lines 18, 19, 22, and 23 while fold lines 26, 27, 30, 31, 34, and 35 are offset inwardly of fold lines 18, 19, 22, and 23. These offset relationships account for the angular dispositions of the corner bevelled panels B1-B6.

Figure 7:
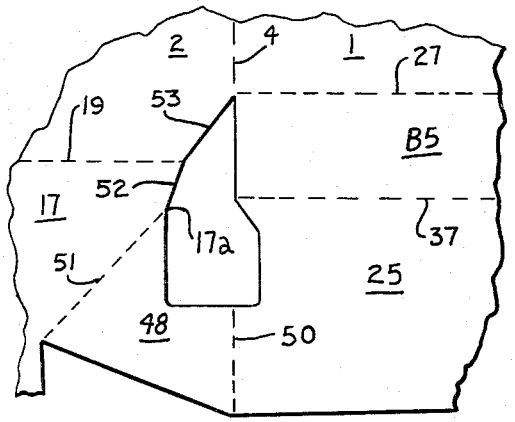
FIG. 7 is an enlarged fragmentary view of one portion of the carton web structure.

According to another feature of this invention, means to interconnect the various end flaps is provided in the form of web structures 42–49. Since each of the web structures 42–49 is virtually identical, only the specific features of web structure 48 will be discussed here in detail. With particular reference to FIG. 7, web structure 48 is foldably joined to end flap 25 along fold line 50. The other end of web structure 48 is foldably joined to end flap 17 along fold line 51, the inner end **17*a* of which is spaced from fold line 19 by edge portion 52 of end flap 17. The associated corner of side wall 2 includes bevelled corner 53. In addition fold line 51 is offset outwardly of end flap 17 with respect to corner 53 and is substantially parallel to corner 53**.

To complete the basic elements of the carton, opening means 54 is defined by severance lines 55 and 56 and is formed in side wall 3 and end flap 21 and is foldably joined to side wall 3 along fold line 57.

Figure 2:
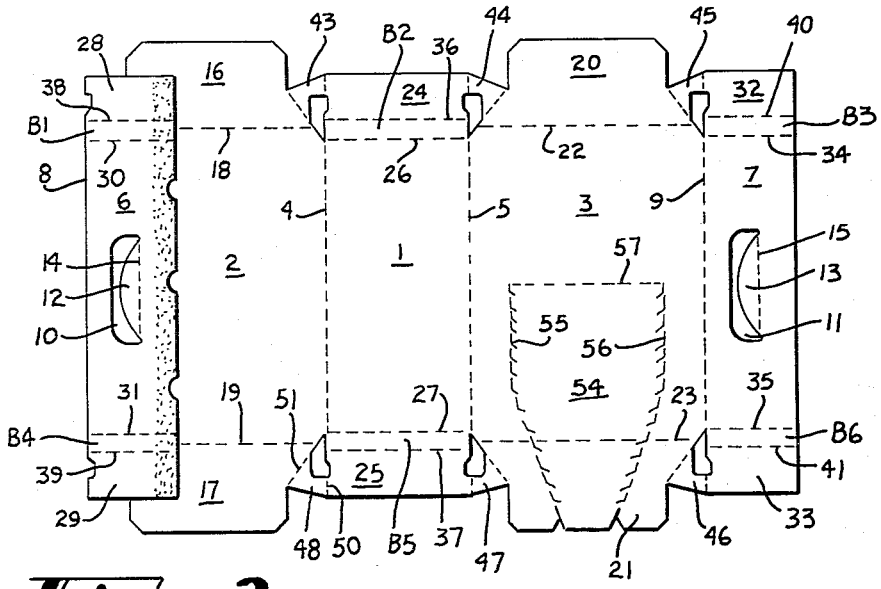
FIGS. 2 and 3 depict intermediate stages through which the blank is glued and manipulated in order to form the open ended carton sleeve shown in FIG. 4.
Figure 3:
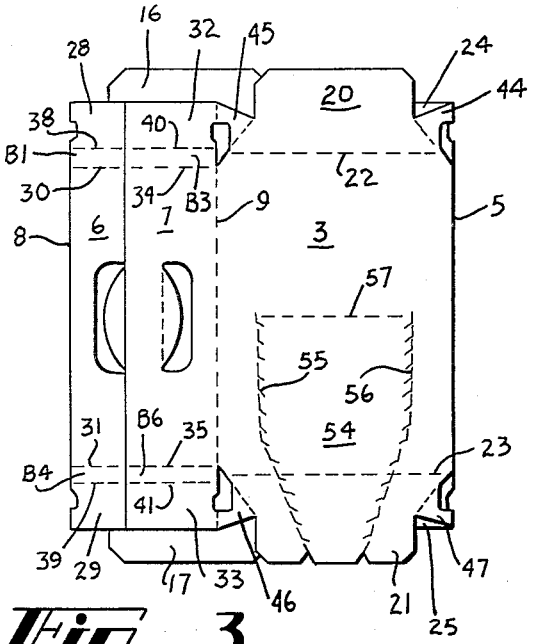

In order to form the carton from the blank shown in FIG. 1, initially it is necessary to elevate and fold top panel 6 and partial end flaps 28 and 29 along fold line 8 into the positions shown in FIG. 2. Glue is then applied to the blank as indicated by stippling in FIG. 2. Following this, the elements of the blank to the right of fold line 5, as viewed in FIG. 2, are elevated and folded to the left to secure the edges of top panels 6 and 7 together and so as to occupy the positions shown in FIG. 3 which represents the completed carton in collapsed condition.

Figure 4:
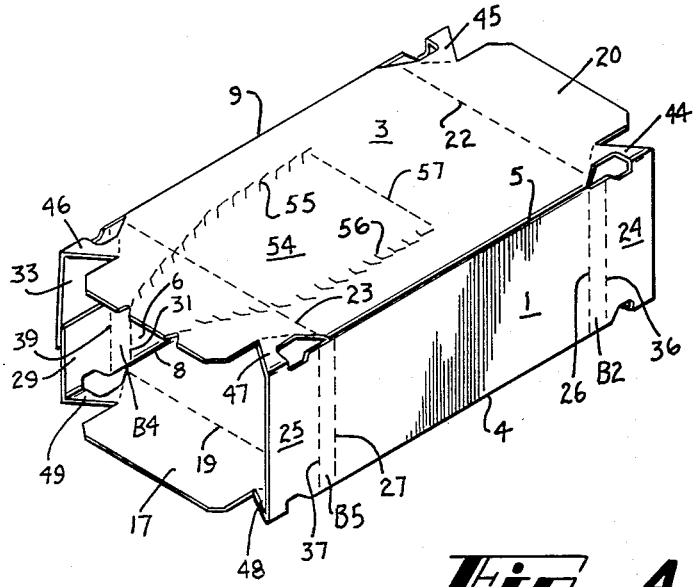
Figure 5:
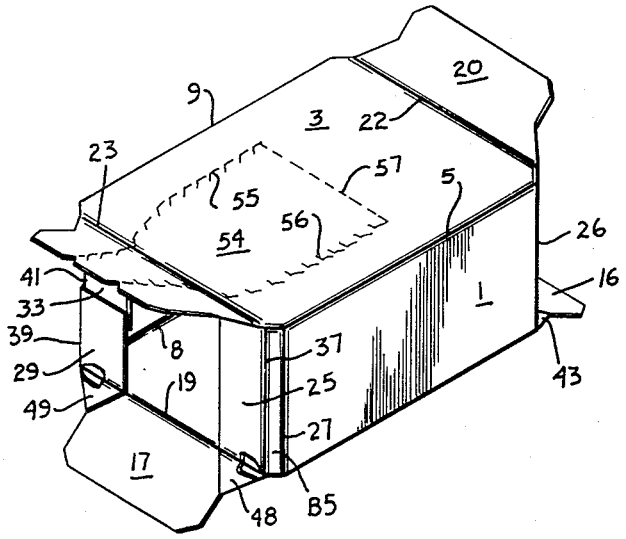
FIG. 5 depicts an intermediate stage through which the end closure structure of the carton is manipulated.

In order to complete the formation of the carton, side walls 2 and 3 are separated and positioned perpendicular to bottom wall 1 and top panels 6 and 7. The carton then appears as shown in FIG. 4.

After the articles are loaded into the carton, the short or minor end flaps 24 and 25 and partial end flaps 28, 29, 32, and 33 are folded inwardly along fold lines 26, 27, 30, 31, 34, and 35 respectively. As this occurs, the offset feature of fold line 51 with respect to bevelled corner 53, as best shown in FIG. 7 and embodied in each of the web structures 42–49, causes the associated short or minor end flaps to "snap" into position. The end flaps are thereby held firmly in place without the necessity of additional machine elements to prevent them from moving out of the position and the necessity of glueing adjacent end flaps is eliminated without compromising the strength of the handle structure.

In addition each end flap 24 and 25 and partial end flap 28, 29, 32, and 33 forms an angular junction at bend lines 36, 37, 38, 39, 40, and 41 respectively and defines the bevelled disposition of bevelled corner panels B1–B6. Therefore the portions of each end flap between bend lines 36–41 and the associated fold line and herein called bevelled corner panels are in contact with portions of the associated packaged article and tend to prevent any undesirable crushing of the carton corners. The remaining portions of the end flaps are disposed perpendicular to the major axis of the carton sleeve which in turn is parallel to the side, top and bottom walls and disposed medially of the sleeve.

Figure 6:
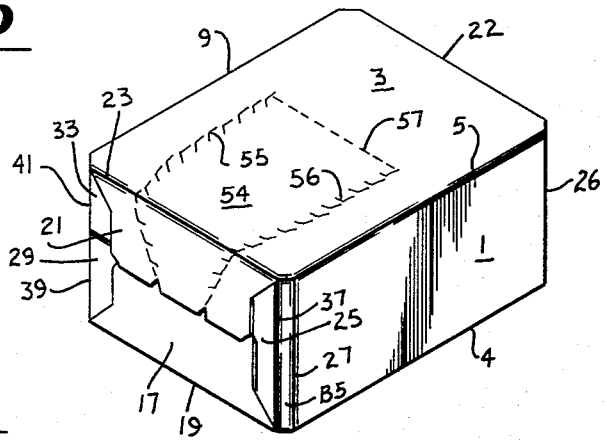
FIG. 6 is an isometric view of a completed carton formed according to this invention.

To complete the tubular carton, end flaps 16 and 17 are elevated along fold lines 18 and 19 respectively. Then an application of glue is made to the upper portions of end flaps 16 and 17 and, following this, end flaps 20 and 21 are lowered along fold lines 22 and 23 respectively. The carton then appears as shown in FIG. 6. Another advantage of this invention, in the completed carton, is that any bowing and weakening of the top wall, which often occurs in a carton utilizing a mechanical end lock, is prevented since all the end flaps are securely maintained in the proper relative positions.

Therefore by the utilization of web structures 42–49, a carton is provided which is very strong and quite resistant to deformation especially at the corners. In addition the carton can be adapted to accommodate articles of varying sizes simply by varying the distance between bend lines 36–41 and the associated fold lines 26, 27, 30, 31, 34, and 35, respectively, as necessary.

INDUSTRIAL APPLICABILITY

By this invention a tubular carton is provided which is extremely strong thereby enabling it to accommodate large primary packages.

I claim:

1. A tubular carton comprising a bottom wall (1), a pair of side walls (2,3) foldably joined respectively to the side edges of said bottom wall, a top wall (6,7) foldably joined along the side edges thereof respectively to the upper edges of said side walls, said side walls being disposed perpendicular to said top and bottom walls to form a sleeve, an end flap (16,17,20,21,24,25,28,29,32,33) foldably joined to each end of said top, bottom, and side walls, at least a portion of each of said end flaps being disposed perpendicular to the major axis of said sleeve, a fold line (26,27,30,31,34,35) disposed between each end flap and the associated one of said walls, and wherein the improvement involves bend line (36–41) disposed in one of said end flaps and generally parallel to said fold line, a pair of web structures (42–49) joined respectively to the ends of said one end flap, a pair of said end flaps being joined respectively to said web structures remote from said one end flap and two of said walls being foldably joined respectively to said pair of end flaps, the corners of said two walls which are associated respectively with said pair of web structures being bevelled and severed from adjacent portions of the carton, and the portions of said one end flap which are disposed on opposite sides of said bend line being angularly related inwardly of the carton.

2. A carton according to claim 1 and further characterized in that opening means (54) is formed in one of said end flaps and the adjoining one of said walls.

3. A carton according to claim 1 and further characterized in that carrying means (10,11) is formed in said top wall.

4. A blank for a tubular carton comprising a bottom wall (1), a pair of side walls (2,3) foldably joined respectively to the side edges of said bottom wall, a pair of top wall panels (6,7) foldably joined respectively to said side walls remote from said bottom wall, a first end flap foldably joined to an end of one of said side walls, a second end flap foldably joined to one of said walls disposed adjacent said one side wall along the end thereof adjacent said first end flap, web structure (42–49) interconnecting said end flaps, the associated corner (53) of said one side wall being bevelled, and characterized in that one edge (51) of said web structure is foldably joined to said first end flap and said one edge is offset from said bevelled corner and is substantially parallel thereto.

* * * * *